US007438654B2

(12) United States Patent
Hu

(10) Patent No.: US 7,438,654 B2
(45) Date of Patent: Oct. 21, 2008

(54) STRUCTURE OF TOY TENNIS RACKET

(76) Inventor: Liang-Fa Hu, No. 208, Jhongping Rd., Shengang Township, Taichung County 429 (TW)

( * ) Notice: Subject to any disclaimer, the term of this patent is extended or adjusted under 35 U.S.C. 154(b) by 225 days.

(21) Appl. No.: 11/391,405

(22) Filed: Mar. 29, 2006

(65) Prior Publication Data

US 2007/0238561 A1 Oct. 11, 2007

(51) Int. Cl.
*A63B 51/02* (2006.01)

(52) U.S. Cl. ..... 473/543; 473/524

(58) Field of Classification Search ..... 473/524, 473/527, 528, 533, 540, 543
See application file for complete search history.

(56) References Cited

U.S. PATENT DOCUMENTS

D192,740 S * 5/1962 Ziabicki ..... D21/729
4,062,541 A * 12/1977 Marks ..... 473/527
4,597,576 A * 7/1986 Haythornthwaite ..... 473/543
5,158,285 A * 10/1992 Flam ..... 473/543
5,253,874 A * 10/1993 Hoffman ..... 473/514
5,261,673 A * 11/1993 Miller ..... 473/514
5,346,212 A * 9/1994 Kuebler ..... 473/543
6,234,922 B1 * 5/2001 White ..... 473/543
6,551,206 B2 * 4/2003 Ha ..... 473/527
2003/0054907 A1 * 3/2003 Soo ..... 473/527
2003/0069096 A1 * 4/2003 Lin ..... 473/521

* cited by examiner

*Primary Examiner*—Raleigh W. Chiu
(74) *Attorney, Agent, or Firm*—Troxell Law Office, PLLC

(57) ABSTRACT

Structure of toy tennis racket, which mainly improves composition of hitting face of toy tennis racket; it stretches string that one side is adhesive across holes around head of tennis racket in horizontal and longitudinal to make network, so that one side of this network is adhesive face and another side is the hitting face; such combination makes hitting face of toy tennis racket that can produce rebound force owing to the flexible network, furthermore, such racket may provide best ventilation effect to reduce wind resistance, you can hit ball easily as if playing with real tennis racket.

3 Claims, 4 Drawing Sheets

FIG. 3-A

STRUCTURE OF TOY TENNIS RACKET

BACKGROUND OF THE INVENTION

1) Field of the Invention

This invention relates to a structure of a toy tennis racket, which includes tensioned string of which one side is adhesive and another side is the hitting face. The adhesive face stops the ball, and the hitting face allows a user to hit the ball without any resistance.

2) Description of the Prior Art

Usually, a "toy tennis racket" is a double sided tennis racket. Please refer to FIG. 1 for the structure of the prior art's toy tennis rocket, which uses a table tennis racket as a frame of tennis racket 1, flat hitting face 11 is fixed in the frame of tennis racket 1, one side of this flat hitting face 11 is to hit the ball, and another side is adhesive face 13 to stop the ball, so that you can hit the ball the expected distance with the racket 1. However this structure is inconvenient and of poor quality, therefore, such structure needs to be improved.

SUMMARY OF THE INVENTION

I. Problem to solve:

(A) Poor ball-hitting surface because flat hitting face 11 is not elastic and also stretched tightly, it can only rebound the ball, but not buffer or disperse force imposed on the racket, and the hand of a player holding the handle of the racket 1 may feel tired or sore. Furthermore, the player may not hit and control the ball the expected distance due to the poor rebound and, therefore, the ball-falling ratio is often bigger than the ball-hitting ratio, so the player may get frustrated in the game and thereby lose interest in it.

(B) It takes effort to move the racket because hitting face 11 may directly block aie when moving the racket due to the non-ventilated flat hitting face 11. The force of the wind resistance on hitting face II results in difficulty in hitting the ball and can cause the player to hit the ball in the wrong direction.

II. Solutions:

1. This invention allows better ball-hitting and reduced wind resistance for a toy tennis racket, which it hits the ball with one side and stops ball with another adhesive side so as to enhance the interest and attraction of the game, as well as reduce injuries caused by too much resistance.

2. This invention stretches string, of which one side is adhesive, across a frame of a tennis racket in horizontal and longitudinal directions to make a network to provide elasticity similar to a real tennis racket.

3. The network holes can reduce wind resistance so that a player can move this racket easily and enjoy playing the game.

DETAILED DESCRIPTION OF THE PREFERRED EMBODIMENTS

Figure 3:
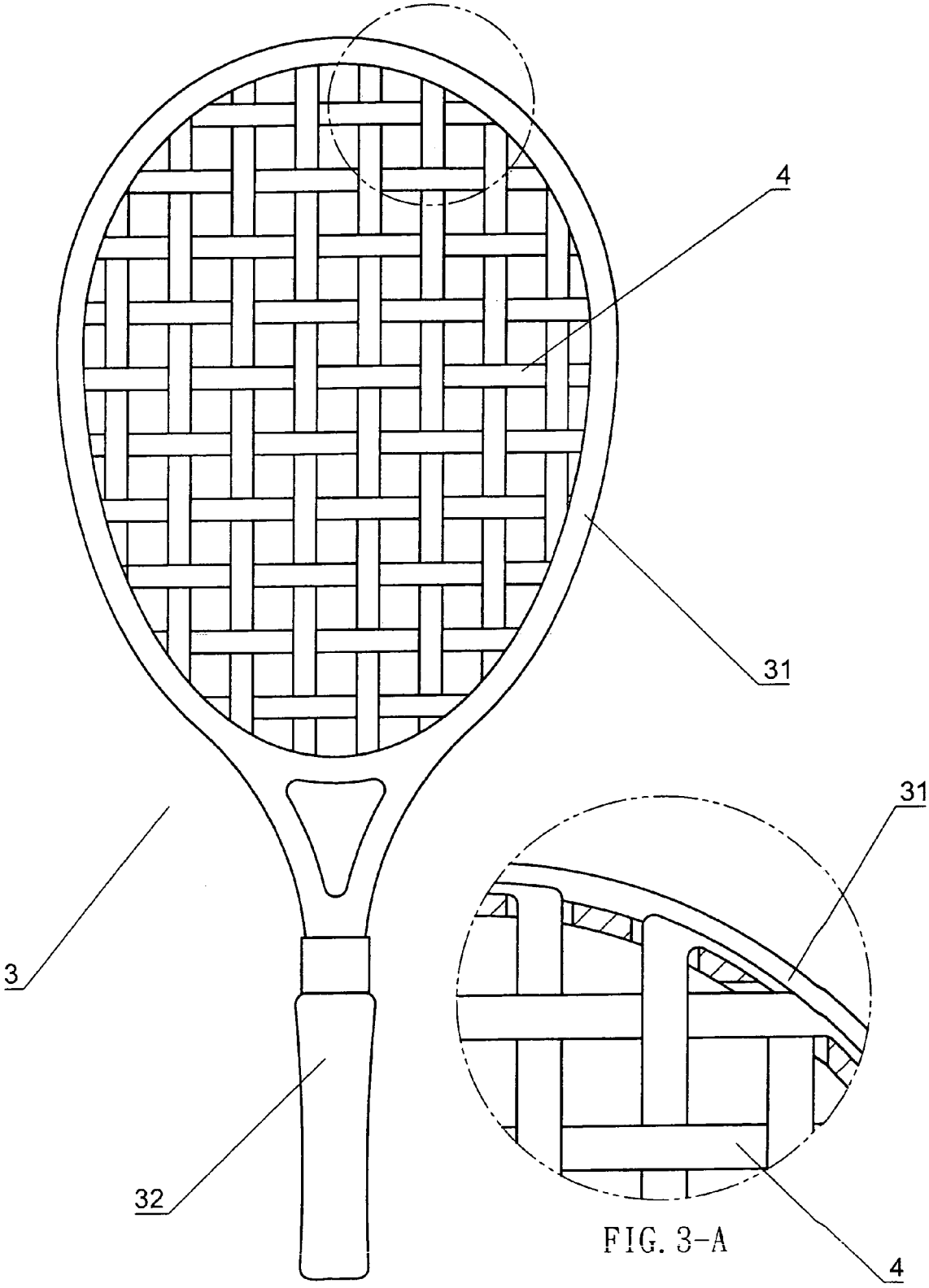
FIG. 3 is a view of the structure of this invention.

FIG. 3-A is a magnified view of the structure of this invention.

Figure 4:
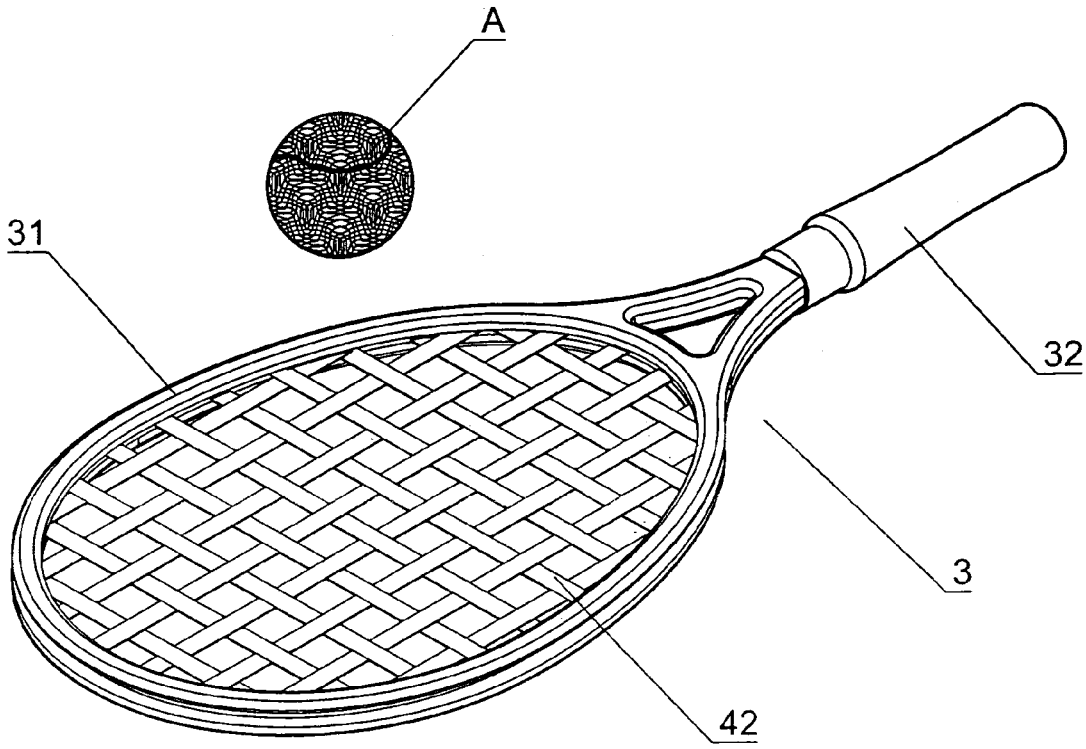

FIG. 4 is a view of the embodiment of this invention in a position to hit ball.

Figure 5:
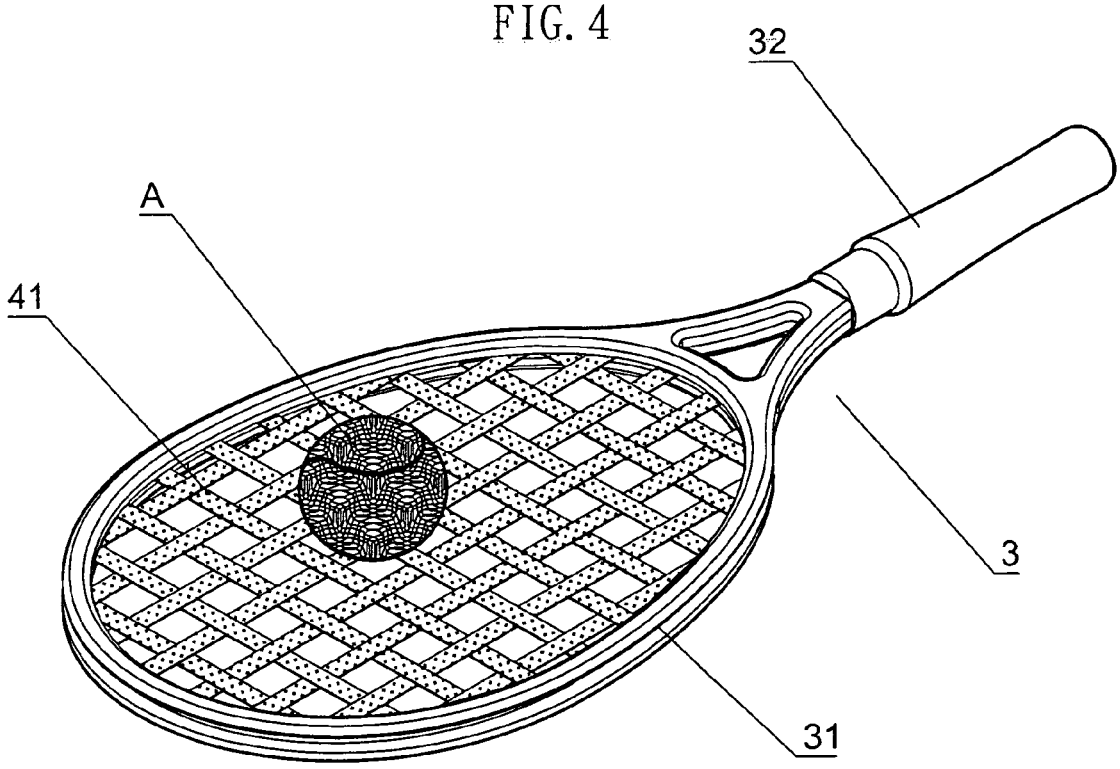

FIG. 5 is a view of the embodiment of this invention in a position to stop ball.

Figure 1:
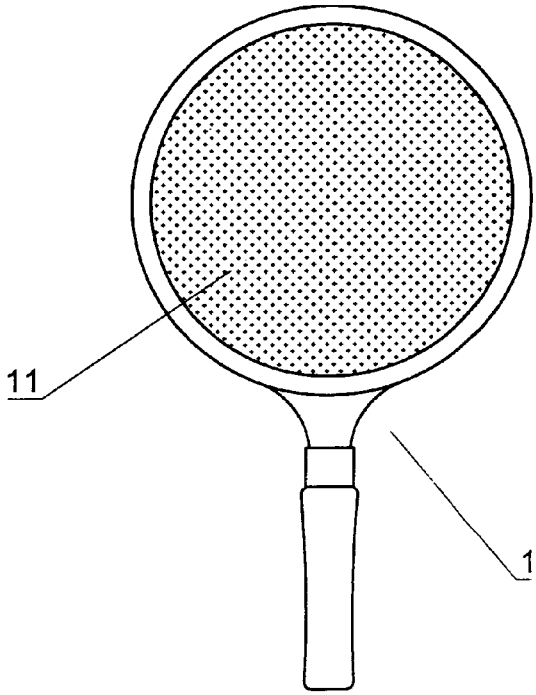
FIG. 1 is a sketch of the structure of the prior art.
Figure 6:
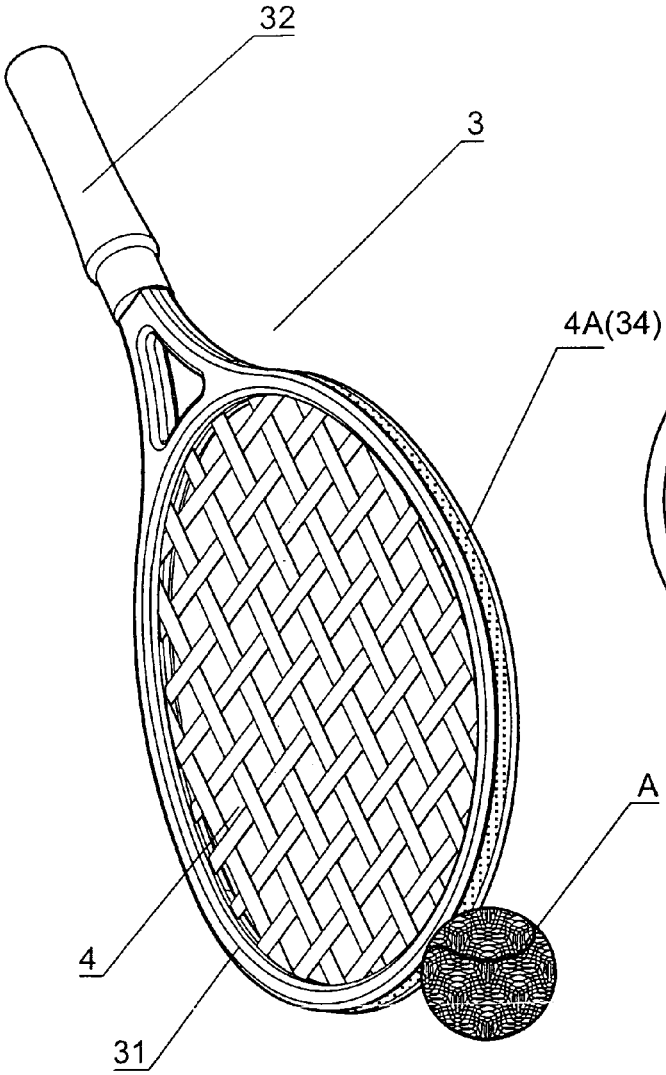

FIG. 6 is a view of the embodiment of this invention in a position to pick up ball.

Figure 7:
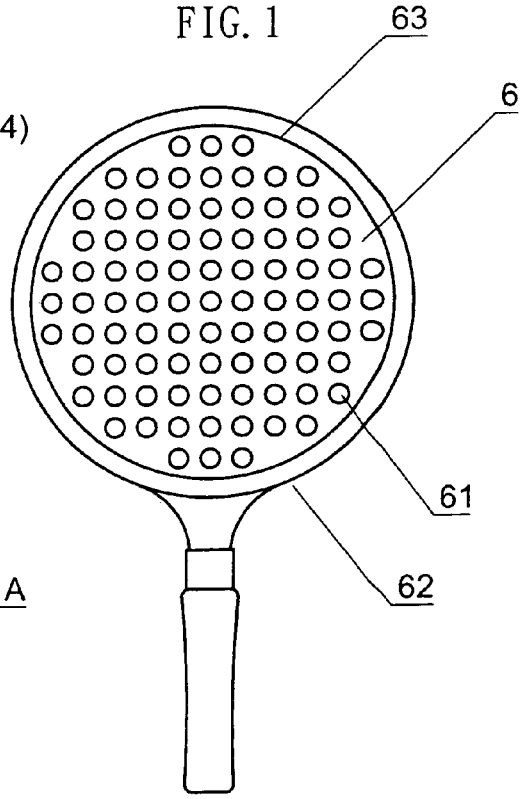

FIG. 7 is a view of another embodiment of this invention.

DETAILED DESCRIPTION OF THE PREFERRED EMBODIMENTS

Figure 2:
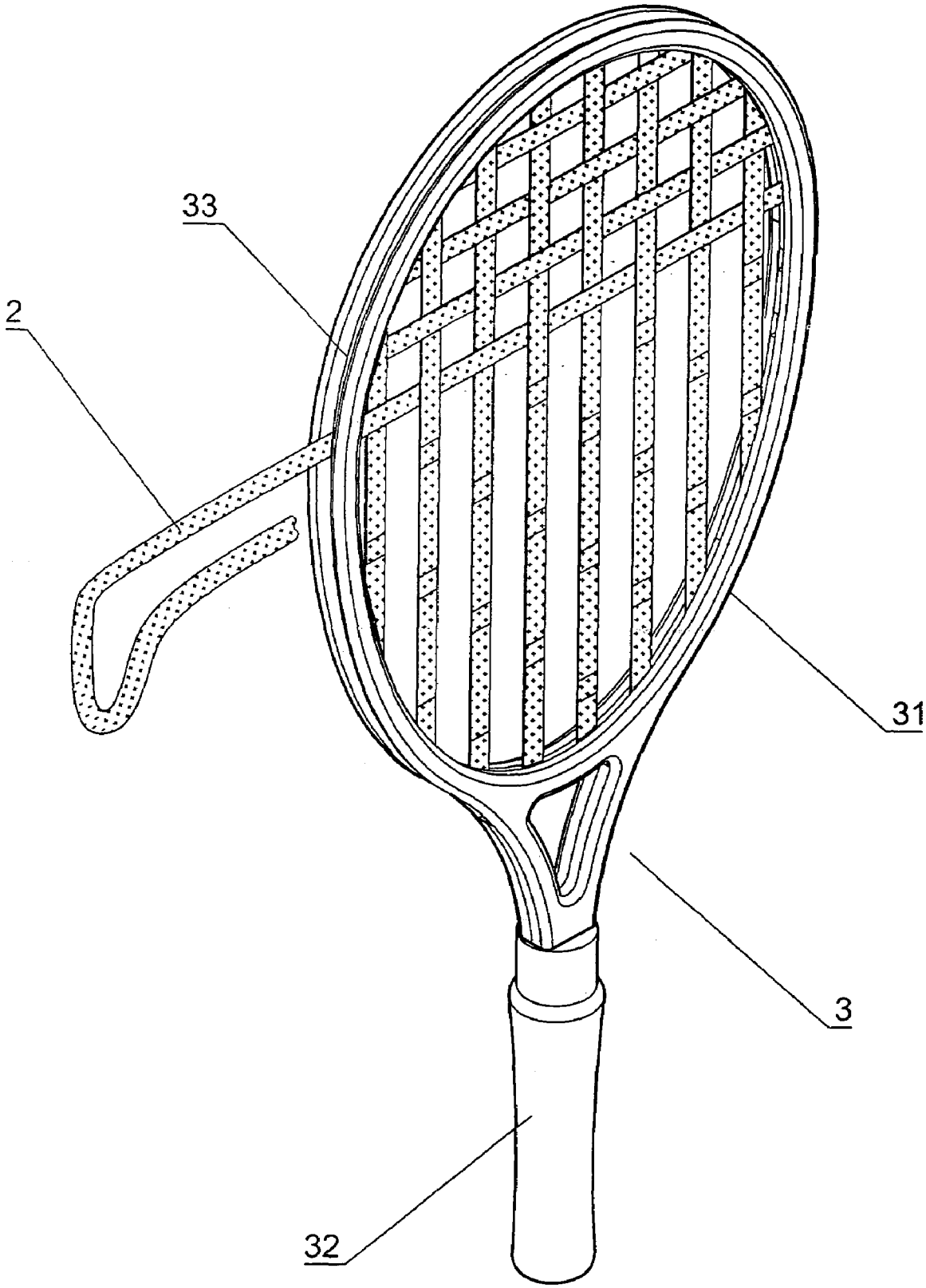
FIG. 2 is the exploded view of the structure of this invention.

Firstly, please refer to FIG. 2, FIG. 3 and FIG. 3-A, which illustrate that this invention is composed of string 2 (e.g., string having a width greater than 0.8 mm) with one adhesive side, tennis racket body 3 with head 31 and handle 32. String 2 is stretched through holes 33 located around head 31 to route the string 2 in horizontal and longitudinal directions to make network 4 in head 31 with one side of this network 4 being an adhesive face 41 and another side is a hitting face 42. This structure is then used in a toy tennis racket 5 to hit and stop a ball (please refer to FIG. 3).

Secondly, please refer to FIG. 4, FIG. 5 and FIG. 6, which illustrates that the structure of this invention is for a game, wherein hitting face 42 can hit ball A the expected distance basing on the rebound force of network 4 that provides stable control of the ball, improved ventilation and reduced wind resistance which simulates playing with a real tennis racket (please refer to FIG. 4). For further convenience the invention allows adhesive face 41 to contact ball A and stop the ball (please refer to FIG. 5). In addition, a concave trough 34 around head 31 and frame border 4A with an adhesive side facing outward is fixed in concave trough 34, so that the player can pick up the ball with racket 3 without bending over, because the ball can be adhered onto frame border 4A (please refer to FIG. 6).

In addition, please refer to FIG. 7, which illustrates that this invention can also apply a single wide belt 6 one side with adhesive, the belt 6 being punctured to have equally distributed holes 61, rectangle holes or other geometrical holes, and then fixed in head 31 to make a body, one side of it having an adhesive face 62 and another side having a hitting face 63 lacking adhesive.

What is claimed is:

1. A structure of a toy tennis racket, comprising:

a tennis racket body formed by a head and a handle, wherein holes extending through the head are distributed equally around the head; and a string is routed through the holes in horizontal and longitudinal directions to form a network, the string being stretched to be under tension, the string having an adhesive side and a non-adhesive side, wherein the string is arranged so that one side of the network has an adhesive face and another side of the network is a hitting face lacking adhesive.

2. The structure of claim 1, further comprising:

a concave trough set around the head of the tennis racket; and a frame border having an outward facing adhesive face is embedded into the concave trough.

3. The structure of claim 1, wherein the string has a width greater than 0.8 mm.

* * * * *